US006883439B1

(12) United States Patent
Moore

(10) Patent No.: US 6,883,439 B1
(45) Date of Patent: Apr. 26, 2005

(54) NON-SWIVELING PNEUMATIC LECTERN

(76) Inventor: Lorraine Moore, 2885 Lorraine Ave., PO Drawer D, Temple, TX (US) 76503

( * ) Notice: Subject to any disclaimer, the term of this patent is extended or adjusted under 35 U.S.C. 154(b) by 74 days.

(21) Appl. No.: 10/443,487

(22) Filed: May 22, 2003

Related U.S. Application Data

(63) Continuation-in-part of application No. 09/815,424, filed on Mar. 22, 2001, now Pat. No. 6,571,720.

(51) Int. Cl.[7] ..... A47B 9/00
(52) U.S. Cl. ..... 108/147; 108/147.19
(58) Field of Search ..... 108/147, 50.01, 108/7, 10, 19, 147.19, 144.11, 150, 92; 248/404, 161, 157, 188.5, 188.2

(56) References Cited

U.S. PATENT DOCUMENTS

| | | | | | |
|---|---|---|---|---|---|
| 3,595,513 | A | * | 7/1971 | Rehlaender | 248/346.01 |
| 4,166,926 | A | | 9/1979 | Sieler | 179/1 |
| 4,381,714 | A | | 5/1983 | Henneberg | 108/147 |
| 4,735,469 | A | | 4/1988 | Liggett | 312/233 |
| 4,784,382 | A | | 11/1988 | Myers | 272/25 |
| 5,078,351 | A | | 1/1992 | Gualtieri | 248/161 |
| 5,131,333 | A | * | 7/1992 | Karasawa et al. | 108/7 |
| 5,287,815 | A | | 2/1994 | Gross | 108/50 |
| 5,806,943 | A | | 9/1998 | Dell | 312/223.3 |
| 5,868,079 | A | | 2/1999 | Charny | 108/7 |
| 5,884,882 | A | | 3/1999 | Nada | 248/188.2 |
| 6,003,452 | A | | 12/1999 | Moore | 108/92 |
| 6,092,474 | A | | 7/2000 | Chen | 108/147 |
| 6,158,357 | A | | 12/2000 | Shih | 108/50.01 |
| 6,182,583 | B1 | | 2/2001 | Larson | 108/147 |
| 6,571,720 | B1 | * | 6/2003 | Moore | 108/147 |
| 6,578,501 | B1 | * | 6/2003 | Moore | 108/147 |

FOREIGN PATENT DOCUMENTS

| | | | |
|---|---|---|---|
| FR | 2592288 | * | 7/1987 |
| GB | 3622640 | * | 1/1988 |
| WO | WO 00/21414 | | 4/2000 |

* cited by examiner

*Primary Examiner*—Jose V. Chen
(74) *Attorney, Agent, or Firm*—Nath & Associates PLLC; Marvin C. Berkowitz; Jarrod N. Raphael

(57) ABSTRACT

The disclosure describes a non-swiveling pneumatic lectern with a base, a hollow column secured to the plate, a sleeve secured to the interior of the column, an adjustable tube having an upper end and a bottom end wherein the first end slides inside the sleeve secured to the column, a pneumatic cylinder disposed within the column for vertically moving the support, an actuation device for engaging and disengaging the pneumatic cylinder, a locking knob for locking the tube at a designated height by pressing the sleeve against the tube, and a top lectern section with a pivotable shelf.

35 Claims, 6 Drawing Sheets

NON-SWIVELING PNEUMATIC LECTERN

The present continuation in part application claims priority to Pending patent application Ser. No. 09/815,424 titled "NON-SWIVELING HEIGHT ADJUSTABLE PODIUM" filed in the U.S. Patent and Trademark Office on Mar. 22, 2001, now U.S. Pat. No. 6,571,720.

FIELD OF THE INVENTION

The present invention relates to a lightweight lectern and speaker stand.

BACKGROUND OF THE INVENTION

In general, lecterns are used by speakers, teachers, trainers, and the like to hold notes and other similar materials during a speech. The prior art lecterns are generally fashioned from wood or wood products as a solid piece of furniture capable of standing without additional support. Such structures are by their nature large and bulky. The bulk and size makes the pieces difficult to store and their rigid construction makes disassembly impossible. If the lectern is height adjustable, the large bulk and size makes it difficult for users to change the height to their individual needs Lecterns serve a variety of functions for a speaker. Beyond holding notes, lecterns provide a leaning surface for the speaker and provide a security barrier between the speaker and his audience. Lecterns are used in a variety of speaking settings from business to entertainment to religious ceremonies, being known in the latter as pulpits.

In an attempt to overcome the difficulties of a rigid structure, folding or collapsible lecterns of cardboard and similar materials have been produced. These devices while providing a portable structure also lack the strength and rigidity necessary to hold heavy objects or books.

While speakers come in all different sizes, a given lectern is typically limited to a fixed height. Height incompatibility between the speaker and lectern can make it difficult and uncomfortable for the speaker to read from the lectern or to lean on the lectern. For example, a speaker who is too tall for the lectern will have to hunch over to use the lectern, while a speaker who is too short will have to strain upwards and may even be substantially eclipsed by a high lectern. This problem is exacerbated in the case of children who may be completely precluded from using a lectern without auxiliary height adjusters, such as stairs or boxes.

Lecterns or podiums have been developed that contain built-in height adjustment features. One example is Richardson U.S. Pat. No. 3,936,109 that teaches a portable podium having a pedestal consisting of a plurality of threaded pipe sections interconnected by threaded couplings. By varying the number of pipe sections employed, the pedestal links and hence the height of the podium, may be adjusted to an extent. Also known in the art are powered adjustable height podiums that typically use an electric motor to provide the motive force for raising and lowering, and thereby adjusting the height of the podium to suit the speaker. Motor control circuitry comprising up and down relays is typically utilized to send current through the motor windings as appropriate for raising or lowering the podium.

None of the references handle the non-swiveling aspects for lecterns and speaker stands specifically, without adding weight to the structure, through additional swivel dampening mechanisms.

Accordingly, it is an object of the present invention to provide a pneumatic, adjustable height lectern.

In addition, it is an object of the present invention to provide a lightweight lectern that has the strength and rigidity of a permanent lectern and the portability of the cardboard lecterns.

SUMMARY OF THE INVENTION

The present invention relates to a non-swiveling pneumatic lectern. The lectern is made of a base, a hollow column secured to the plate, a sleeve secured to the interior of the column, and an adjustable tube having an upper end and a bottom end, wherein the first end slides inside the sleeve secured to the column. The lectern also has a pneumatic cylinder disposed within the column for vertically moving the support, an actuation device for engaging and disengaging the pneumatic cylinder, and a locking knob for locking the tube at a designated height by pressing the sleeve against the tube. The top section of the lectern is four panels in the shape of a box with a pivotable shelf.

The present invention also relates to non-swiveling pneumatic speaker stand with a pivotable shelf.

BRIEF DESCRIPTION OF THE DRAWINGS

In the detailed description of the preferred embodiments of the invention presented below, reference is made to the accompanying drawings, in which.

The present invention is detailed below with reference to the listed Figures.

DETAILED DESCRIPTION OF THE PREFERRED EMBODIMENTS

Before explaining the present invention in detail, it is to be understood that the invention is not limited to the particular embodiments herein and it can be practiced or carried out in various ways.

The invention relates to a non-swiveling pneumatic lectern and non-swiveling pneumatic speaker stand. The present invention is not limited to an adult lectern or stand, but can incorporate a child size version as well.

Figure 1:
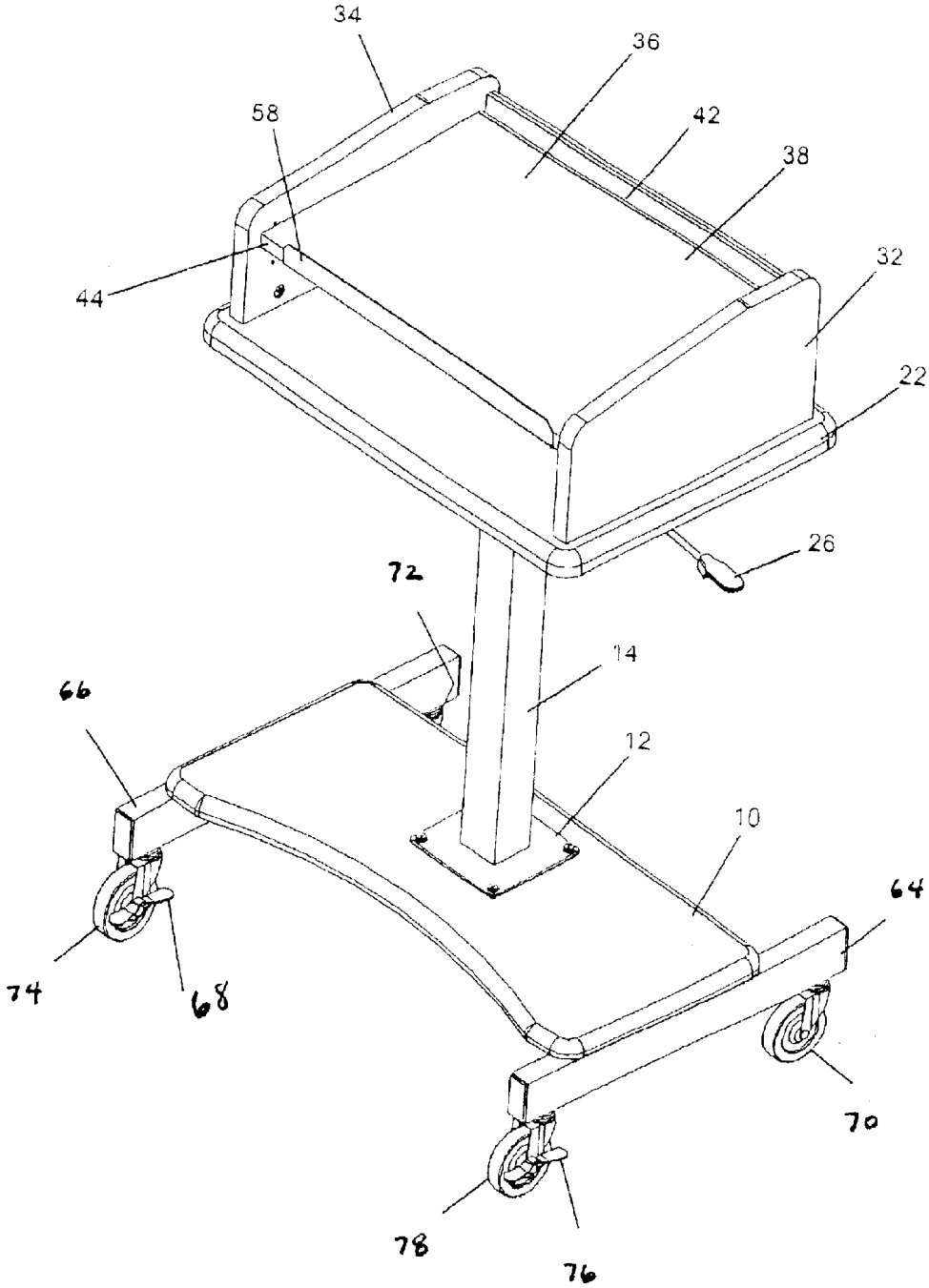
FIG. 1 is a back perspective view of the pneumatic lectern.

Now and with reference to the Figures, FIG. 1 shows back perspective view of the pneumatic lectern.

The non-swiveling pneumatic lectern has a base (10). A base plate (12) is secured to the base (10) and a hollow column (14) is secured to the base plate. The base plate (12) and the hollow column (14) are both secured with conventional fasteners, such as threaded screws or similar attaching means. It is within the scope of the invention that the hollow column (14) could be rectangular or triangular or cylindrical of any angular shape that would enable control of round "tube" in "tube" swiveling, which occurs in conventional podiums.

Figure 2:
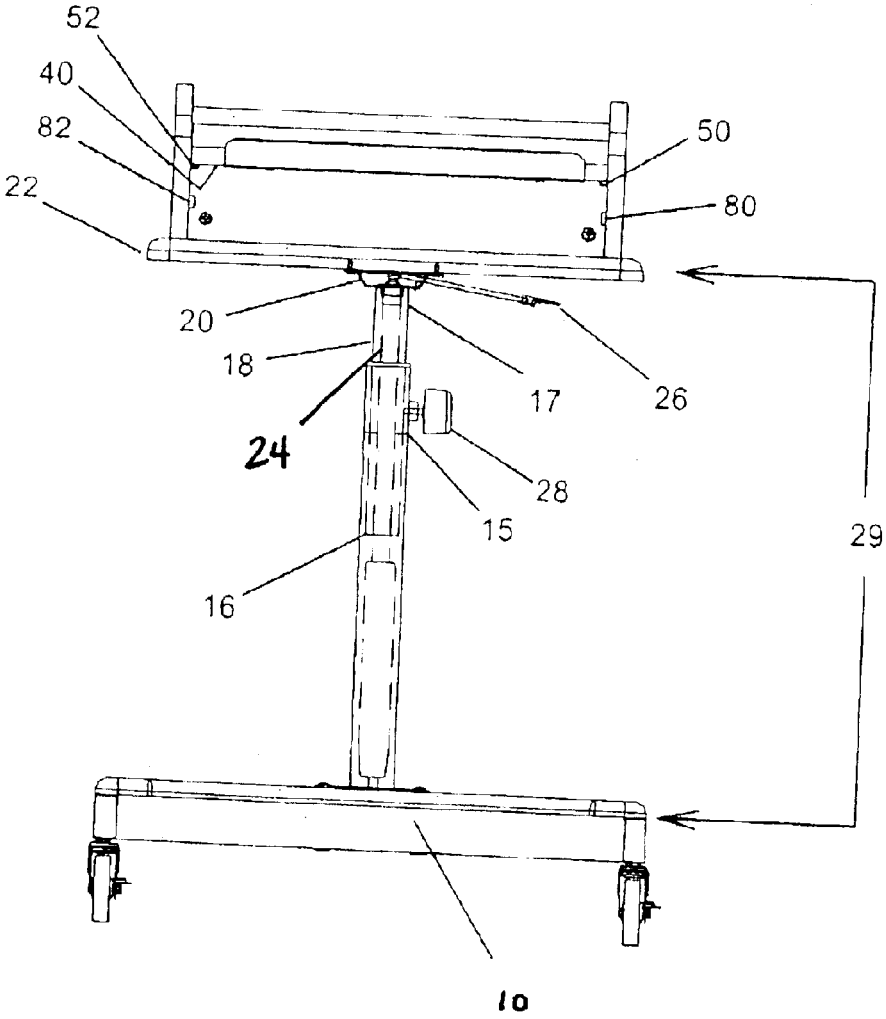
FIG. 2 is a back view of the pneumatic lectern.

The lectern has a sleeve (15) secured to the interior of the hollow column. An adjustable tube (18) with an upper end (16) and a lower end (17) slide into the sleeve (15) and is secured to the hollow column (14). As seen in FIG. 2, the lower end (17) of the adjustable tube (18) slides inside the sleeve. The sleeve can be made from plastic, a coated metal, or a fabric.

FIG. 2 also shows the pneumatic cylinder (24) is located within the hollow column. The pneumatic cylinder (24) is used to vertically move the support. The pneumatic cylinder (24) provides between 50 psi and 75 psi.

The lectern also has an actuation device (26) for engaging and disengaging the pneumatic cylinder. A locking knob (28) is present for locking the adjustable tube at a designated height (29) by pressing the sleeve against the adjustable tube. FIG. 2 shows both the location of both the actuation device (26) and the locking knob (28).

Figure 3:
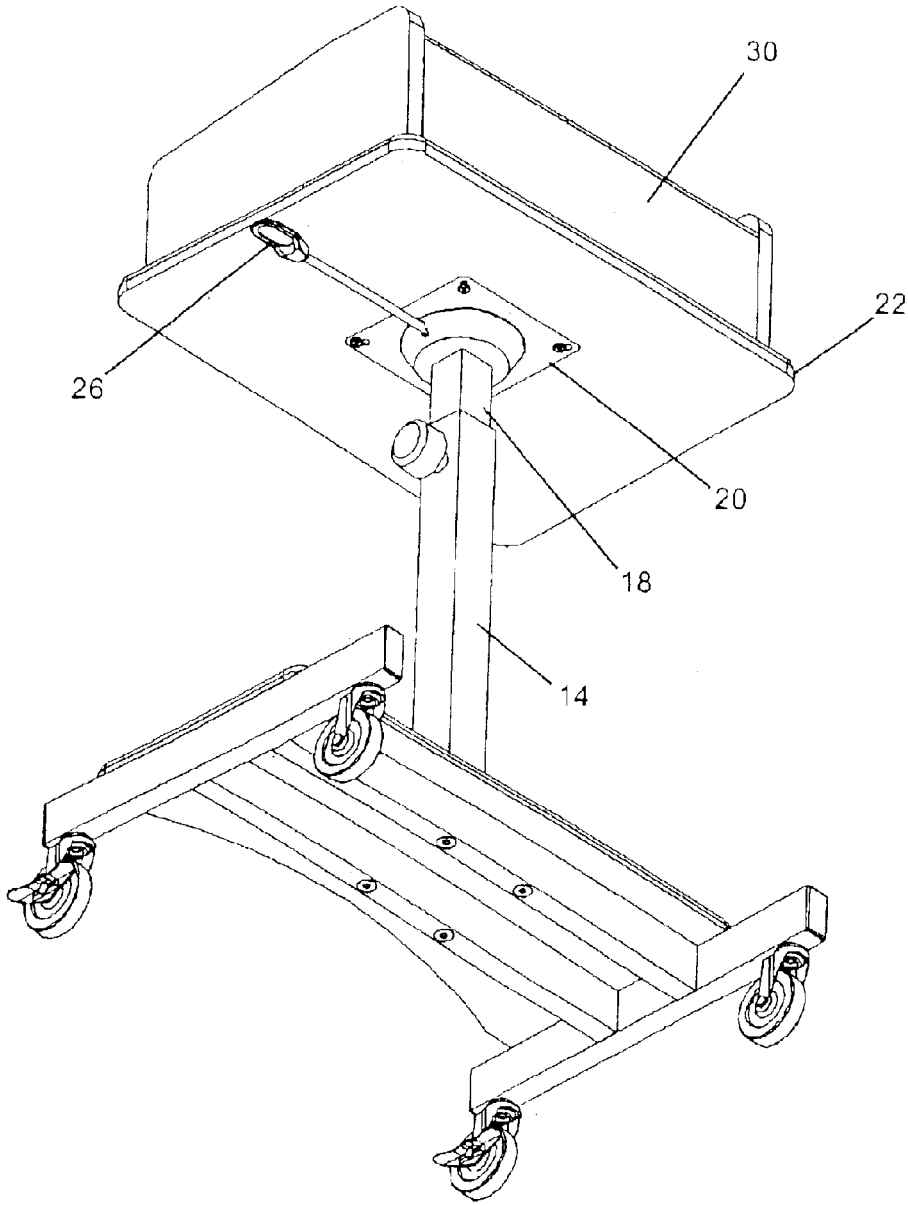
FIG. 3 is a perspective view of the invention from the bottom.
Figure 5:
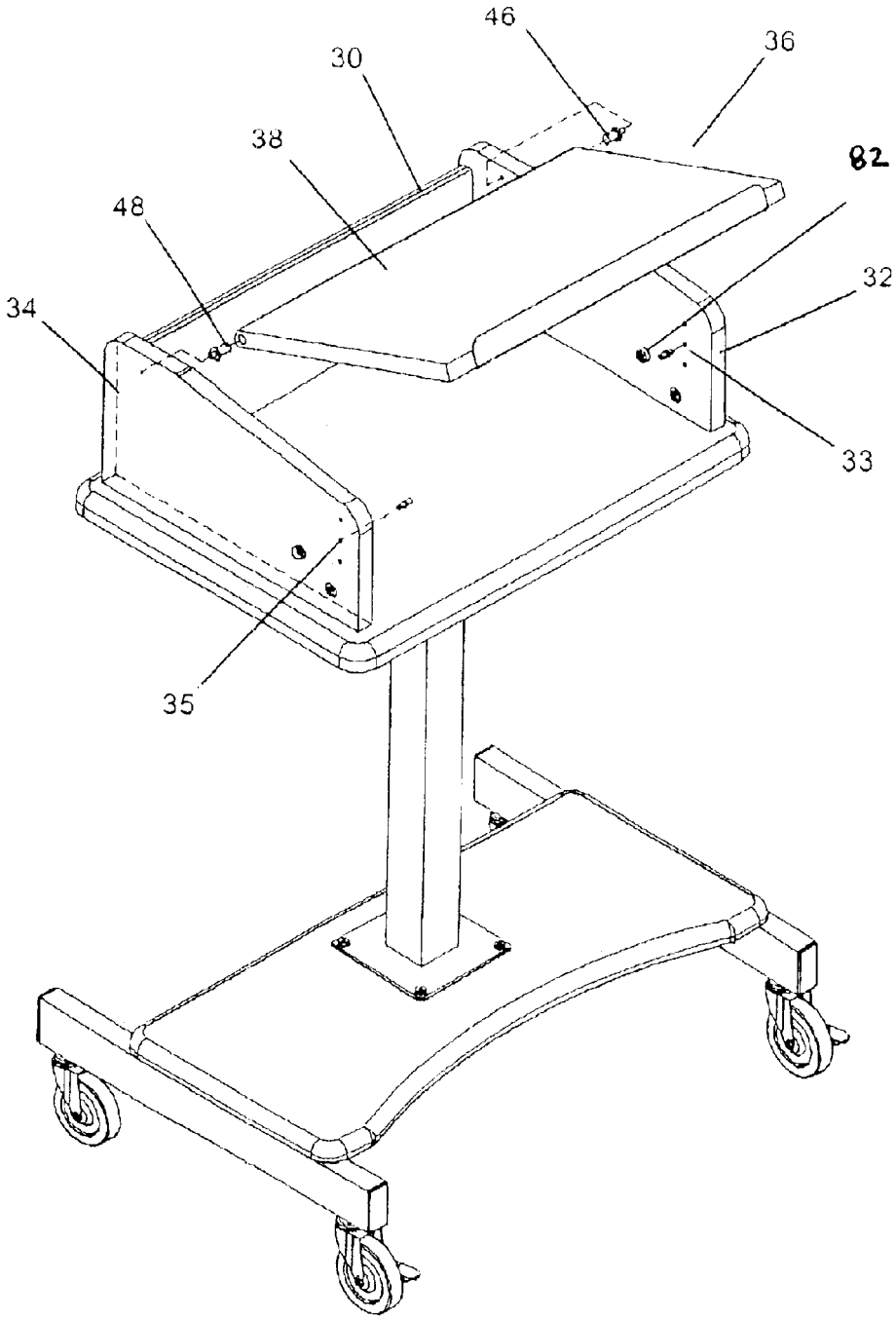
FIG. 5 is perspective view of the invention from the back.

The lectern has a support (22) adapted for use as a podium, wherein the lectern holds a speaker's notes, provides a leaning surface for the speaker, and provides a security barrier between the speaker and his audience. As shown in FIG. 3, a front panel (30) is attached to the support. As shown in FIG. 5, a right side panel (32) and a left side panel (34) are secured to the front panel (30) and the support (22).

Returning to FIG. 1, a pivotable shelf (36) is located between the right side panel (32) and the left side panel (34). The pivotable shelf (36) has a shelf top (38), a shelf bottom (40), a shelf front (42), and a shelf back (44). The shelf front (42) is connected to the front panel (30) and the pivotable shelf (36) fits within the right side panel (32) and left side panel (34).

Figure 6:
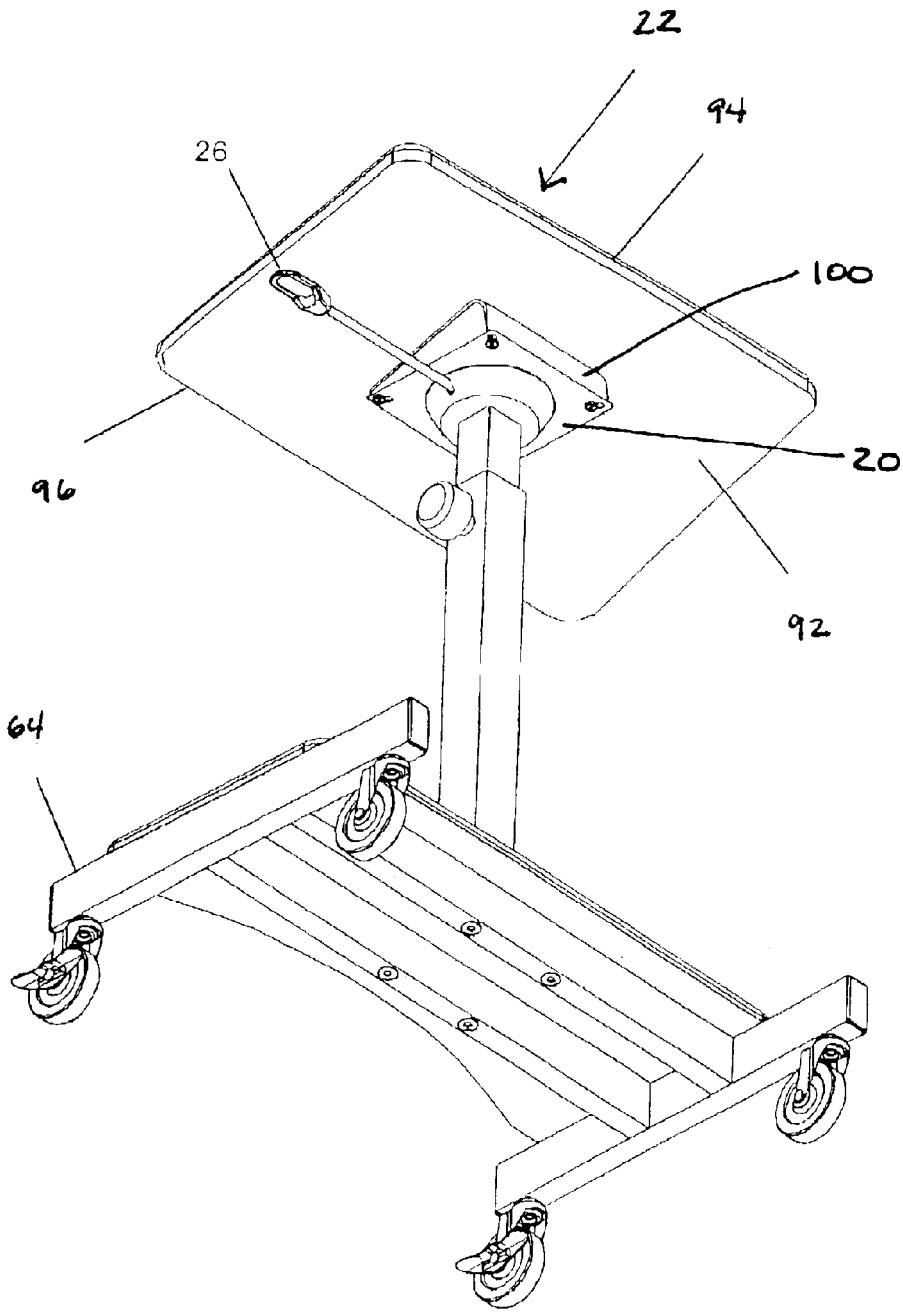
FIG. 6 is a perspective view of the speaker stand from the bottom.

The invention is also a non-swiveling pneumatic speaker stand, as shown in FIG. 6. The support (22) has a support top, a support bottom (92), a support front (94), and support back (96). The support (22) is fixed on a wedge (100) that has an angle from the support plate (20).

Returning to FIG. 1, the invention contemplates that the speaker stand and lectern have a first base support (64) secured to the base (10) and a second base support (66) secured to the base on the end opposite and parallel to first base support (64). The first base support (64) and the second base support (66) can also have casters (68, 70, 72, and 74) to allow the stand or lectern to move easily from place to place. The casters (68, 70, 72, and 74) can have locks (76, 78) to prevent the lectern or stand from rolling.

In the preferred embodiment, the lectern and stand have overall height in the collapsed position of 41 inches and an overall height in the extended position of 51 inches. The width ranges between 18 inches and 30 inches. The overall weight does not exceed 50 pounds.

The invention contemplates that the all components other than the pneumatic cylinder are plastic.

Figure 4:
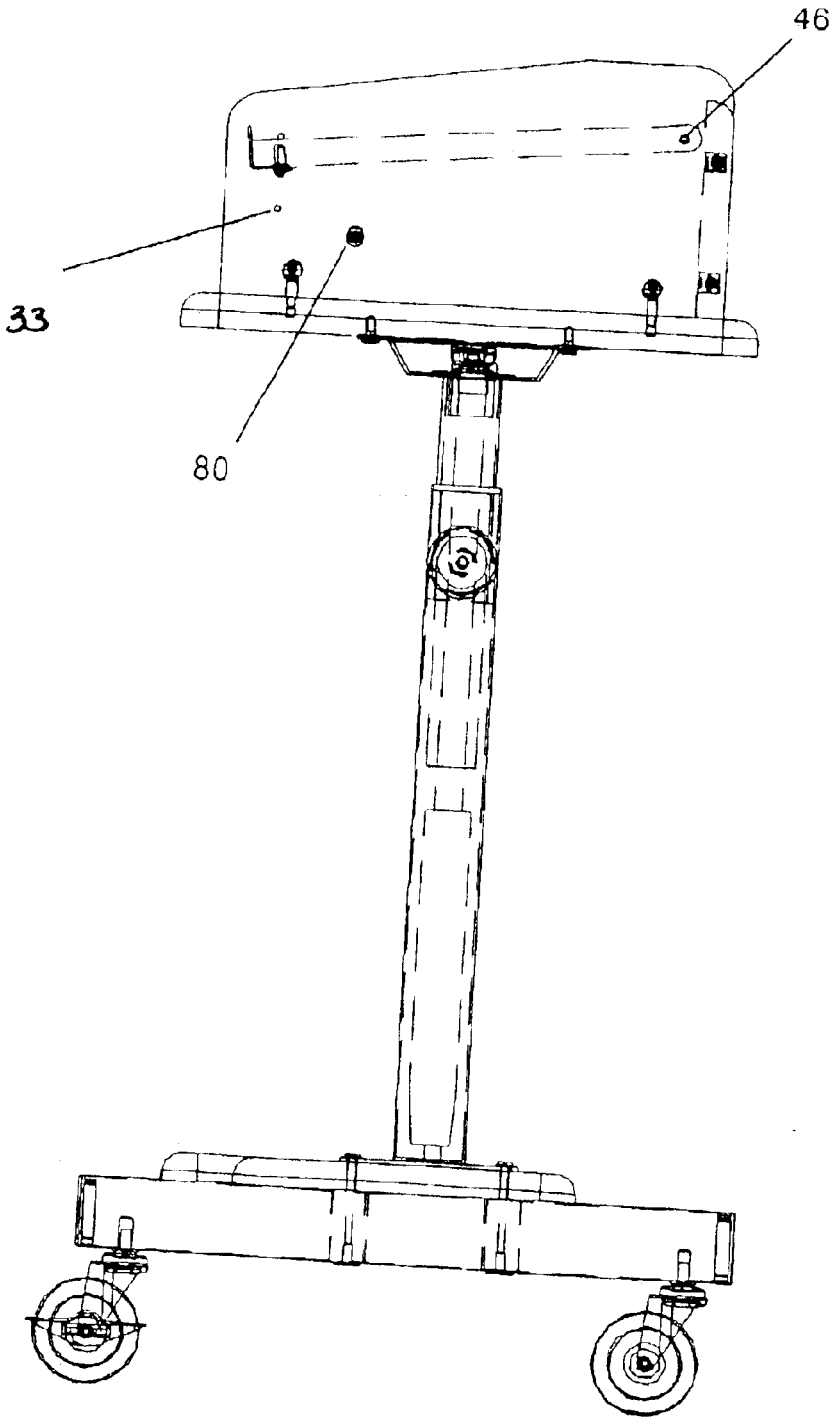
FIG. 4 is a cut-a-way side view of the lectern.

As seen in FIGS. 4 and 5, the lectern can have a first rubber bumper (80) secured to the right panel and a second rubber bumper (82) secured to the left panel for stopping the pivoting shelf (36).

Although the preferred embodiment has a base, which has the hollow column (14) passing through the base to attach to the base plate, it is possible that the column is simply secured to the base if the base was constructed of a solid material.

The invention also contemplates that the upper end of the hollow column (14) attaches to the support plate (20) though a square hole. The square shape is critical because the angular shape prevents any swivel movement of the lectern without the need for any additional swivel dampening mechanism.

The base of the lectern can take any number of forms. The preferred embodiment is an "H" shape, wherein the base comprises, as shown in FIG. 1, a first base support (64) in parallel with a second base support (66). Other orientations such as a star or "X" shape are also contemplated by this invention.

It is contemplated that this invention could be made partially of metal for the base, column, tube, and plate and wood for the front panels and sides. It is with the scope of the invention that this could be an all-metal podium or an all-plastic podium, except for the pneumatic piston, which generally is metal.

While this invention has been described with emphasis on the preferred embodiments, it should be understood that within the scope of the appended claims the invention might be practiced other than as specifically described herein.

What is claimed is:

1. A non-swiveling pneumatic lectern comprising:

a. a base;

b. a base plate secured to the base;

c. a hollow column secured to the base plate;

d. a sleeve secured to the interior of the column;

e. an adjustable tube with an upper end and a lower end wherein the lower end slides inside the sleeve secured to the hollow column;

f. a pneumatic cylinder disposed within the hollow column for vertically moving a support;

g. an actuation device for engaging and disengaging the pneumatic cylinder;

h. a locking knob for locking the adjustable tube at a designated height by pressing the sleeve against the adjustable tube;

i. a front panel secured to the support;

j. a right side panel secured to the front panel and the support;

k. a left side panel secured to the front panel and the support;

l. a pivotable shelf comprising:

i. a shelf top;

ii. a shelf bottom;

iii. a shelf front;

iv. a shelf back; and v. wherein the shelf front is connected to the front panel and the pivotable shelf fits within the right side panel and left side panel.

2. The lectern of claim 1, further comprising:

a. a first base support secured to the base on the end opposite the support;

b. a second base support secured to the base on the end opposite the support and that is disposed parallel to the first base support.

3. The lectern of claim 2, wherein the first and second base supports are on a plurality of casters.

4. The lectern of claim 3, wherein the plurality of casters further comprise at least two locks.

5. The lectern of claim 1, wherein the overall height of the lectern in the collapsed position is 41 inches.

6. The lectern of claim 1, wherein the overall height of the lectern in the extended position 15 is 51 inches.

7. The lectern of claim 1, wherein the pneumatic cylinder provides between 50 psi and 75 psi.

8. The lectern of claim 1, wherein the width of the lectern ranges between 18 inches 30 inches.

9. The lectern of claim 1, wherein the overall weight of the lectern does not exceed 50 pounds.

10. The lectern of claim 1, wherein all components other than the pneumatic cylinder, are plastic.

11. The lectern of claim 1, wherein the hollow column comprises a shape selected from the group consisting of a square, a rectangle, and a cylinder.

12. The lectern of claim 1, wherein the sleeve consists of a material selected from the group consisting of a plastic, a coated metal, and a fabric.

13. The lectern of claim 1, further comprising a first rubber bumper secured to the right panel and a second rubber bumper secured to the left panel.

14. The lectern of claim 1, further comprising a support plate and a support, wherein the support plate is attached to the support for receiving the upper end of the adjustable tube.

15. The lectern of claim 1, wherein the right side panel further comprises a first pin hole.

16. The lectern of claim 1, wherein the left side panel further comprises a second pin hole.

17. The lectern of claim 1, wherein the shelf front is connected to the front panel with a first spring loaded pin and a second spring loaded pin.

18. The lectern of claim 1, further comprising a first pin is secured in the first pin hole and a second pin is secured in the second pin hole.

19. The lectern of claim 1, further comprising a stop secured to the shelf back.

20. A non-swiveling pneumatic speaker stand comprising:

a. a base;

b. a base plate secured to the base;

c. a hollow column secured to the base plate;

d. a sleeve secured to the interior of the column;

e. an adjustable tube with an upper end and a lower end wherein the lower end slides inside the sleeve secured to the hollow column;

f. a support plate attached to a support for receiving the upper end of the adjustable tube, wherein a support comprises
   i. a support top;
   ii. a support bottom;
   iii. a support front;
   iv. a support back, and v. wherein the support is fixed on a wedge that has an angle from the plate;

g. a pneumatic cylinder disposed within the hollow column for vertically moving the support;

h. an actuation device for engaging and disengaging the pneumatic cylinder; and i. a locking knob for locking the adjustable tube at a designated height by pressing the sleeve against the adjustable tube.

21. The speaker stand of claim 20, further comprising:

a. a first base support secured to the base on the end opposite the support; and b. a second base support secured to the base on the end opposite the support and that is disposed paralled to the first base support.

22. The speaker stand of claim 21, wherein the first base support and the second base support are on a plurality of casters.

23. The speaker stand of claim 22, wherein the plurality of casters further comprise at least two locks.

24. The speaker stand of claim 20, wherein the overall height of the lectern in the collapsed position is 41 inches.

25. The speaker stand of claim 20, wherein the overall height of the lectern in the extended position is 51 inches.

26. The speaker stand of claim 20, wherein the pneumatic cylinder provides between 50 psi and 75 psi.

27. The speaker stand of claim 20, wherein the width of the lectern ranges between 18 inches and 30 inches.

28. The speaker stand of claim 20, wherein the overall weight of the lectern does not exceed 50 pounds.

29. The speaker stand of claim 20, wherein all components other than the pneumatic cylinder are plastic.

30. The speaker stand of claim 20, wherein the hollow column comprises a shape selected from the group consisting of a square, a rectangle, and a cylinder.

31. The speaker stand of claim 20, wherein the sleeve consists of a material selected from the group consisting of a plastic, a coated metal, and a fabric.

32. The speaker stand of claim 20, further comprising a first rubber bumper secured to the right panel and a second rubber bumper secured to the left panel.

33. The speaker stand of claim 20, further comprising a stop secured to the support back.

34. A non-swiveling pneumatic lectern comprising:

a. a base;

b. a hollow column and adjustable tube coaxially aligned about an axis and operatively connected in telescopic relation, one of said column and said tube connected to the base;

c. a sleeve connected to the interior of the column;

d. a pneumatic cylinder disposed within the hollow column that supports a lectern at a designated height in relation to said base;

e. an actuation device that engages and disengages the pneumatic cylinder;

f. a lock that locks the adjustable tube at the designated height in relation to the sleeve in the hollow column;

wherein said hollow column and said adjustable tube are not rotatable in relation to each other around said axis.

35. A non-swiveling pneumatic speaker stand comprising:

a. a base;

b. a hollow column and adjustable tube coaxially aligned about an axis and operatively connected in telescopic relation, one of said column and said tube connected to the base;

c. a sleeve connected to the interior of the column;

d. a support plate in which a wedge angles said support plate;

e. a pneumatic cylinder disposed within the hollow column that supports a speaker stand at a designated height in relation to said base;

f. an actuation device that engages and disengages the pneumatic cylinder;

g. a lock that locks the adjustable tube at the designated height in relation to the sleeve in the hollow column;

wherein said hollow column and said adjustable tube are not rotatable in relation to each other around said axis.

* * * * *